United States Patent [19]

Michels

[11] 4,103,644

[45] Aug. 1, 1978

[54] APPARATUS FOR COATING ONE SIDE ONLY OF STRIP MATERIAL

[76] Inventor: Norman C. Michels, 30500 Salem Dr., Bay Village, Ohio 44140

[21] Appl. No.: 724,079

[22] Filed: Sep. 16, 1976

[51] Int. Cl.[2] ..... B05C 1/08; B05C 11/06

[52] U.S. Cl. ..... 118/62; 118/63; 118/65; 118/67; 118/223

[58] Field of Search ..... 118/62, 63, 65, 67, 118/202, 203, 244, 210, 223; 427/349, 360

[56] References Cited

U.S. PATENT DOCUMENTS

| | | | |
|---|---|---|---|
| 649,392 | 5/1900 | Barnes | 118/203 |
| 3,178,305 | 4/1965 | Ward | 427/360 X |
| 3,228,788 | 1/1966 | Teplitz | 427/350 X |
| 3,589,331 | 6/1971 | Westervelt | 118/62 |
| 3,828,723 | 8/1974 | Herman | 118/65 X |
| 3,854,446 | 12/1974 | Stievenart et al. | 118/223 |
| 3,929,097 | 12/1975 | Kanda et al. | 118/62 |

*Primary Examiner*—John P. McIntosh

*Attorney, Agent, or Firm*—Bosworth, Sessions & McCoy

[57] ABSTRACT

A method of and apparatus for continuously, evenly and uniformly coating one side only of a moving strip of material, such as steel, with molten zinc or other fluid coating material while effectively preventing the coating material from contacting the opposite side of the moving strip.

24 Claims, 16 Drawing Figures

APPARATUS FOR COATING ONE SIDE ONLY OF STRIP MATERIAL

BACKGROUND OF THE INVENTION

This invention relates to one side coating of a moving strip of material with a fluid coating material. The moving strip may be metal, fabric or other substantially impervious material, and may be of any width or thickness. The coating fluid may be a molten metal, paint, lacquer or other fluid which will solidify as by reduction in temperature and/or passage of time. However, in the attached drawings and the following specification the invention will be specifically illustrated and described as applied to the continuous one side galvanizing of steel strip.

Various procedures for the production of such a product have been proposed as it has been recognized that one side galvanized steel sheet is most desirable for uses, such as automobile bodies, where a paint or other surface finish must be applied directly to the steel surface on one side and the opposite side must be protected against corrosion. In one prior procedure, one side of the strip has been coated with a protective material which will prevent the adherence of molten zinc to that side and the strip then passed through a pot of molten zinc in which the zinc adheres in the usual manner to the other side. This is followed by chemical or physical removal of the coating on the first side. In another prior proposal for the production of one side galvanized steel strip, a roller has been partially immersed in a pot of molten zinc and the strip moved over the roller with one side thereof in contact therewith. However, difficulty is encountered because of the tendency of the molten zinc to travel over the edges of the strip to the opposite side. In some cases, the edges have been trimmed after coating but this is an expensive and wasteful procedure.

SUMMARY OF THE INVENTION

It is among the objects of the present invention to provide an improved apparatus for one side coating of a moving strip of material whereby contact of coating material with the uncoated side of the strip is effectively prevented. Another object of my invention is the provision, in apparatus for one side coating of a moving strip, of apparatus which is adapted, without adjustment or change and without shutdown of the processing line, to accommodate a substantial range of strip widths and gauges while maintaining an effective prevention of contact of the coating material with the uncoated side of the strip. A further object is the provision of apparatus for one side coating of a moving strip which includes means permitting ready access for maintenance, repair or adjustment purposes.

The present invention, as applied to the production of one side galvanized steel strip, contemplates a gas tight enclosure or housing within which the moving strip is brought up to the desired temperature. After being heated, heat treated and/or surface conditioned the strip, while still within the gas tight enclosure, passes through a galvanizing pot in which one side of the strip travels over one or more coating rolls which are partially submerged in molten zinc in the pot and which rotate as the strip passes thereover so that the side of the strip adjacent the roll is uniformly coated with zinc. Concurrently with the application of the zinc coating to one side of the strip a flow of heated protective atmosphere, for example a hydrogen-nitrogen mixture, is forced transversely outwardly over the opposite side and edge portions of the strip and the upper exposed portions of the coating roll or rolls with sufficient force and volume to prevent travel of molten zinc over the edges of the strip to the uncoated opposite side and the deposit of splattered zinc on the opposite side. This outward flow of gas across the strip edges on the uncoated side, and against the exposed portions of the coating roll or rolls, is maintained by suitable manifolds, deflectors, etc., the gas flow over the edge portions of the uncoated side being maintained for a distance along the travel of the strip from the area of first contact of the strip with a coating roll to the area where the molten zinc on the coated side has cooled sufficiently to solidify to a degree that it will not reach the uncoated side.

As suggested above, in addition to the edge protective gas flow over the uncoated side of the strip, my coating apparatus preferably includes gas wiping means for removing excess zinc from the coating roll or rolls when the strip width is less than the width of the rolls. This means includes elongated nozzles extending axially of and adjacent to the surface of the coating roll or rolls. These nozzles direct a jet or stream of gas against the exposed end portions of the rolls, which end portions extend beyond the edges of the strip being coated, and rotationally in advance of the area where the strip receives molten zinc from the roll. These jets wipe the zinc from the exposed ends of the coating roll or rolls and prevent splatter of zinc therefrom from reaching the uncoated side of the strip and also inhibit build up of zinc at the edges of the coated side which may result in undesirable edge beads.

The protective atmosphere which is maintained in the zinc pot enclosure is utilized in the edge protection and roll gas wiping procedures. After the zinc coating has cooled sufficiently that it will not flow on to the uncoated side the protective gas blasts cease and further cooling of the strip may be expedited by passing it through a section of the housing in which the strip is cooled, as by circulation of an externally cooled atmosphere or passage through a suitable liquid, to a temperature at which the uncoated side will not oxidize when exposed to air. After passing out of the cooling section into the air the strip may be further processed in any desired manner as by stretcher levelling, shearing, coiling, etc. Other objects and features of my invention will appear from the following Detailed Description of the illustrated embodiment.

DETAILED DESCRIPTION

As has been previously pointed out, the present invention is adapted for continuous one side coating of strip material with various types of fluid coating materials, but in this specification the particular embodiment of the invention which has been illustrated and which will be described in detail, relates to coating one side only of a moving steel strip with molten zinc, which procedure is commonly known as "galvanizing".

Figure 1:
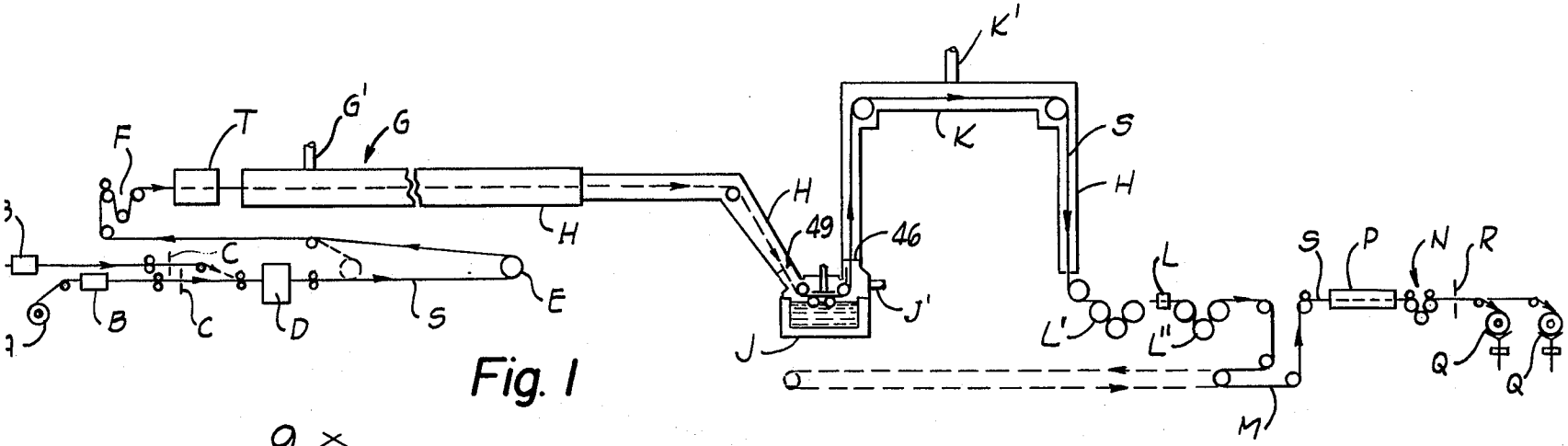
FIG. 1 is a diagrammatic illustration of a continuous one side galvanizing line for steel strip embodying my invention and also showing certain customary equipment at the entry and exit ends of the line.
Figure 8:
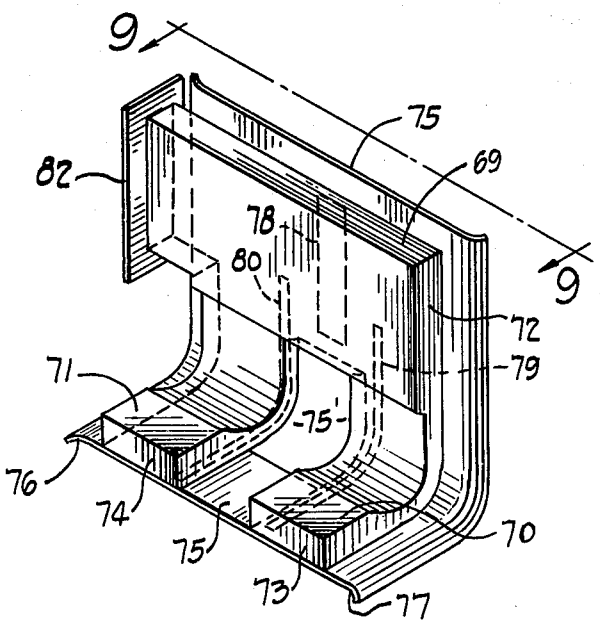
FIG. 8 is a detached perspective view of the corner and vertical gas manifold and deflector plate unit which extends around the exit strip turning roll.

Referring now to FIG. 1 of the drawings, a continuous one side coating galvanizing line for steel strip is schematically illustrated. Starting on the left hand side, the various elements of this line include coil payoff reels A, strip levellers B, shears C and a welder D. Strip from either of the coils A may be welded by the welder D to the trailing end of the strip S which is being processed. An entry looper E is adapted, in well known manner, to provide a reservoir of strip whereby movement of the strip being processed may continue while strip from a new coil A is being welded in place by welder D. From the looper, the strip passes through a tension bridle F, which provides the necessary resistance to give the desired tension in the strip as it is processed, and then moves on through a strip cleaning unit T in which the strip surface is thoroughly cleaned on both sides. The clean strip then enters the furnace section G which is enclosed in the gas tight housing H. From the furnace section the strip passes while still in the protective housing H, to the galvanizing pot structure J which also is enclosed in the housing H. Upon leaving the galvanizing pot J, strip S is moved upwardly in the protective housing to and through a cooling section K from which it passes out into the air to the entry bridle rolls L′ of a stretcher leveller L. These bridle rolls L′ pull the strip S through the entire processing line from the tension bridle rolls F and move the strip at the desired lineal speed and under the desired tension.

From the exit bridle rolls L″ the strip passes to the exit looper M. After leaving the looper M and prior to passing through the exit tension bridle N the strip may be subjected to treatment, such as the application of a protective coating, in the chemical treatment section P. The tension bridle N moves the strip from the leveller bridle L″ through the exit looper L and the treatment section P to winding reels Q after passing through the shear R which severs the strip upon completion of a coil on a coiler Q.

Referring now to FIGS. 2–7 which illustrate the enclosed galvanizing pot J and its associated apparatus, the protective housing H extends from the furnace G and encloses the pot structure J and provides a gas tight protected path for the movement of the strip S from the furnace G to and through the galvanizing equipment. A baffle plate 49, having a slot 49′ through which the strip passes, extends across the housing H at the entrance to the pot J and, together with the baffle 46 at the exit of pot J, provides means whereby atmospheres of different compositions may if desired be maintained in the furnace G, pot structure J and cooling section K.

The pot structure J includes an exterior casing 10 within which the metal zinc holding vessel or pot 11 is supported in spaced relation to the walls of the casing 10. A bath of molten zinc 12 is contained within the vessel 11, the surface of the zinc being indicated at 13. To maintain the bath of molten zinc in the vessel 11 at the proper temperature, heating means such as the electric heating elements 14 may be mounted on the walls of the casing 10. The supply to and level 13 of the molten zinc in vessel 11 is maintained by the supply pipe 11′ (see FIG. 4) which connects in well known manner to a zinc melting pot (not shown) in which zinc pigs are melted and the level maintained at the level desired to be maintained in the vessel 11.

Figure 2:
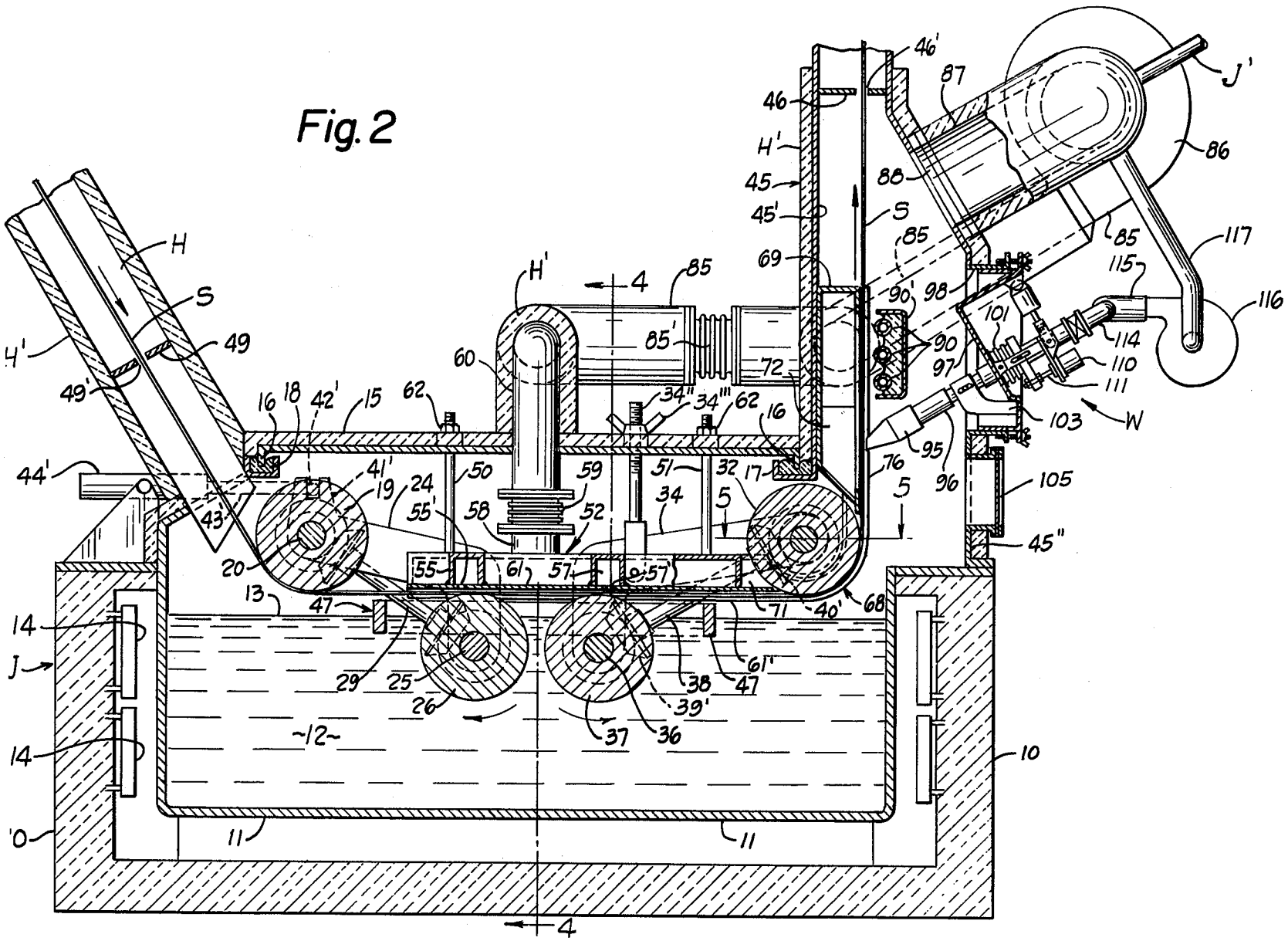
FIG. 2 is an illustrative vertical cross sectional view, not to accurate scale, taken substantially on line 2—2 of FIG. 3 and showing the galvanizing pot apparatus together with the gas flow manifolding, etc. whereby the uncoated side of the strip is protected against contact with the molten zinc.

The removable access and manifold support cover 15 for the vessel 11 forms a part of the gas tight housing of the pot structure J and is provided with a downwardly extending flange 16 around its outer periphery which extends into a trough 17 which extends around an access opening in the top of the pot structure J. The trough 17 and the flange 16, together with the mass of fibrous material 18, provide a gas tight seal for the cover 15 when it is in operating position as seen in FIG. 2. The weight of the top and the structures supported thereby hold them in position during operation of the line. To conserve heat the walls of the housing H, the cover 15, and the associated piping are covered with insulating material H′.

Figure 4:
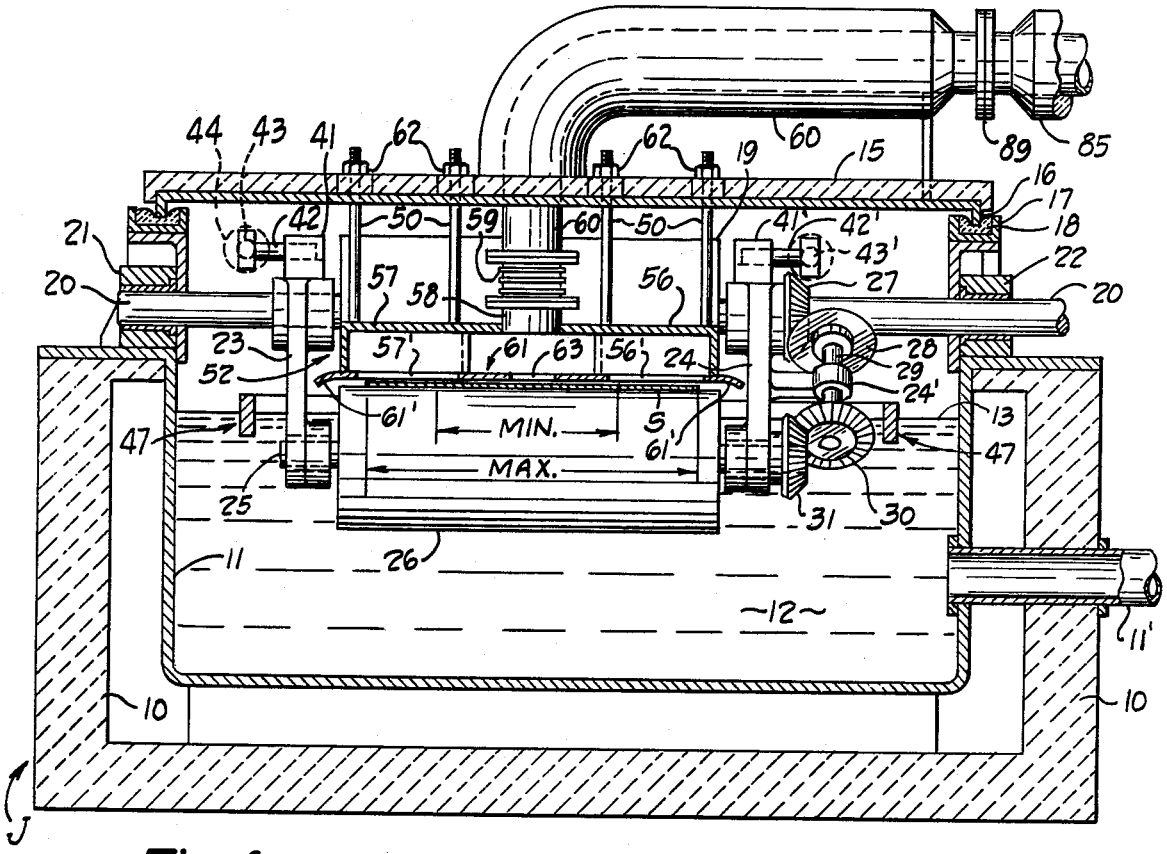
FIG. 4 is a vertical transverse cross sectional view, taken substantially on line 4—4 of FIG. 2 and showing one coating roll and a portion of the gas flow directing manifolds and deflector plates.

The entering end strip turning roll 19 is mounted on and rotates with a shaft 20, which, as best seen in FIG. 4, is supported in bearings 21 and 22 in the front and back walls of the vessel 11. A pair of coating roll support arms 23 and 24 are rotatively mounted on shaft 20, (see FIGS. 2 and 4). At their outer ends these support arms have bearings for the shaft 25 on which the first coating or wetting roll 26 is securely mounted. This pivotal mount of the shaft 25 and roll 26 permit vertical adjustment of the roll 26 relative to axis of roll 19 in a manner and for purposes which will be later described. The shaft 20 of the turning roll 19 extends outwardly through the rear wall of the vessel 11 and may be connected to suitable driving means (not shown) whereby roll 19 may be rotated at the desired speed, preferably such that its peripheral speed is approximately equal to the lineal speed of travel of the strip S. The first coating roll 26 is driven from the shaft 20 through a bevel gear 27 on shaft 20, a meshing bevel gear 28 on connecting shaft 29, a bevel gear 30 on the lower end of shaft 29 and meshing bevel gear 31 on shaft 25 to which the first coating roll 26 is secured. As it may be desired that the speed of rotation of coating roll 26 be such that its peripheral speed is either the same as, greater or less than the lineal strip speed, the relative size of bevel gears 28 and 30 on shaft 29 may be so established as to give the desired peripheral speed to roll 26. The direction of rotation of roll 26 is such that the top of the roll moves in the same direction as the strip.

Figure 3:
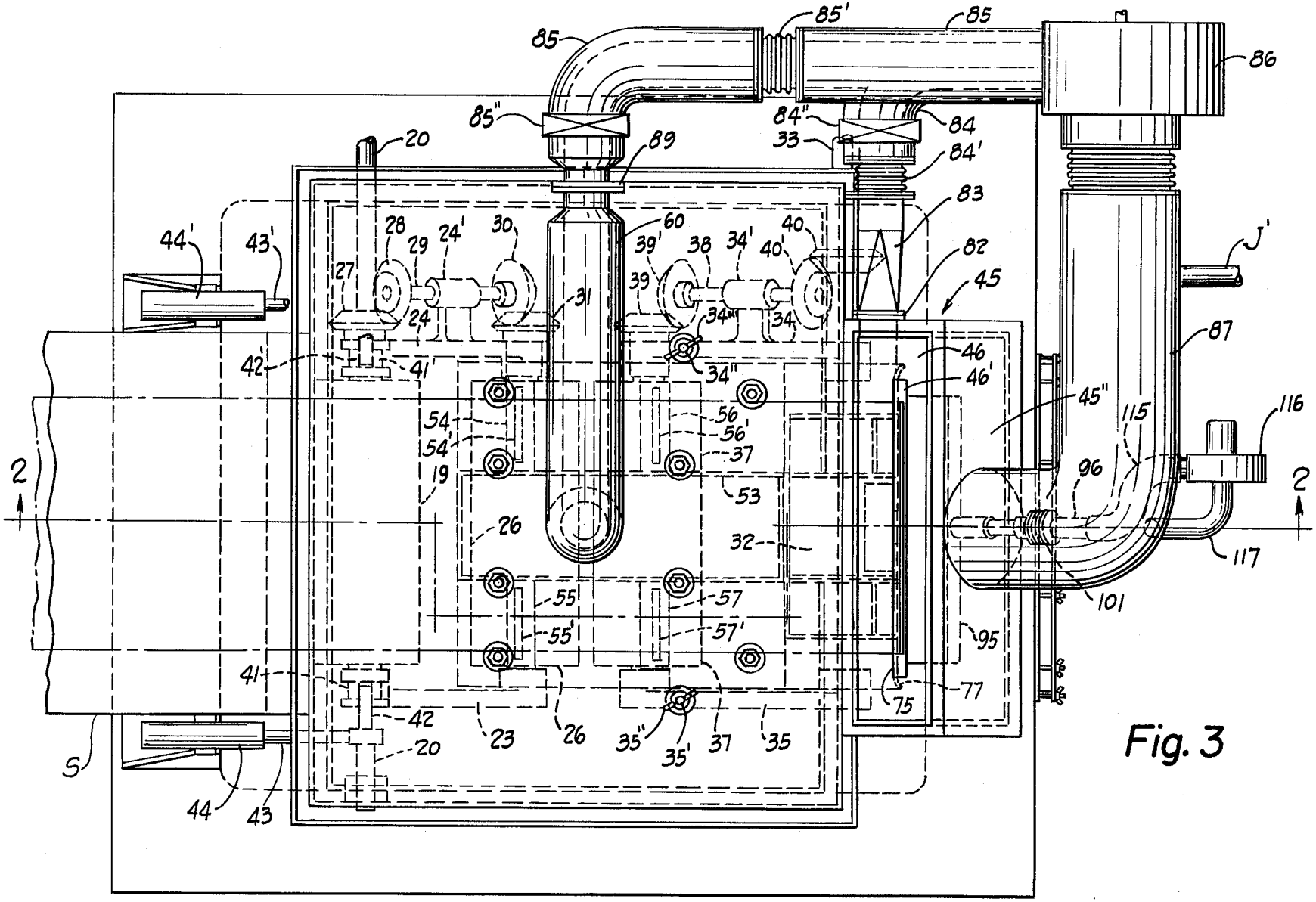
FIG. 3 is a plan view of the apparatus shown in FIG. 2.
Figure 5:
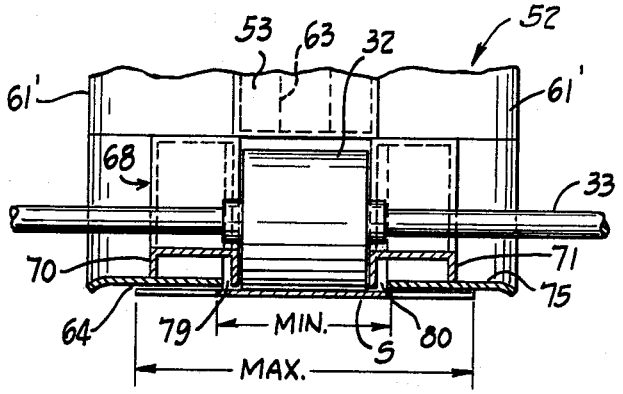
FIG. 5 is a detached illustrative fragmentary cross sectional view, taken substantially on line 5—5 of FIG. 2 and showing the exit strip turning roll and the gas directing manifolds and deflector plate adjacent thereto.

Adjacent the opposite end of the vessel 11 from entering strip turning roll 19 is an exit strip turning roll 32 the length of which, as seen in FIG. 5, is less than the width of the narrowest strip to be processed. As indicated in FIGS. 3 and 5, the roll 32 is securely mounted on a shaft 33 which is supported in the walls of the vessel 11 in the same manner as shaft 20 and which may be adapted to be driven by suitable means (not shown) in the same direction as the entering strip turning roll 19. This shaft 33 also carries coating roll support arms 34 and 35 on which the shaft 36 of the second coating roll 37 is mounted. A driving connection from shaft 33 for roll 37 is provided through shaft 38 and bevel gears indicated at 39, 39' and 40, 40'. A support and bearing member 24' for bevel gear shaft 29 is carried by arm 24 so that shaft 29 moves with arm 24 during adjustment of the position thereof by means to be described in the following paragraph. In the same manner, a support and bearing member 34' for bevel gear shaft 38 is carried by arm 34.

It will be observed that the vertical positions of the coating rolls 26 and 27 may be adjusted by swinging their support arms 23, 24 and 34, 35 about the turning roll shafts 20 and 33 respectively. This adjustment may be effected by any suitable means, FIGS. 2 and 3 illustrating upwardly extending yoke members 41 and 41' which are rotatively supported on the shaft 20 and rigidly secured to the support arms 23 and 24 respectively. Pins 42, 42' mounted on the ends of rods 43, 43' lie in elongated slots in the upper ends of yokes 41 and 41' so that simultaneous inward or outward movement of the rods 43, 43' will cause the support arms 23 and 24 to move about the shaft 20 with resulting lifting or lowering of the first coating roll 26. Operating means for the rods 43, 43' are indicated at 44, 44'. These may be of any suitable type such as screw threaded adjustment mechanisms, hydraulic cylinder actuators, etc., it being understood that they should be capable of imparting accurate simultaneous movement to the rods 43, 43' and securing same in any desired position of adjustment whereby the vertical position of the first coating roll 26 relative to the strip pass line may be accurately varied in small increments.

The second coating roll 37, as has been previously explained, is mounted on a shaft 36 supported by arms 34 and 35. The vertical position of the arms 34 and 35, and accordingly the position of roll 37, may be adjusted by means of rods 34" and 35' which are pivotally secured at their lower ends to the arms 34 and 35 respectively and which extend upwardly through the cover 15 (see FIGS. 2 and 3). The upper ends of rods 34" and 35' are threaded to receive the adjusting nuts 34''' and 35". By turning these nuts, which are preferably provided with suitable locking means, the vertical position of the roll support arms 34 and 35 may be adjusted thus enabling the vertical position of the second coating roll 37 to be accurately located with respect to the pass line of the strip as it travels between the turning rolls 19 and 32.

Surrounding the coating rolls 26 and 37 is a well containment and dross barrier, generally indicated at 47, and comprising walls which project both above and below the surface 13 of the zinc bath 12 and enclose the surface area of the portion of the bath in which the coating rolls 26 and 37 are disposed. The barrier structure 47 is supported and held in position by brackets, not shown to avoid confusion, extending from and mounted on the walls of pot 11. The function of the barrier is to prevent dross, surface particulate matter, or surface contaminants of any kind which would be detrimental to the coating applied to the strip, from contact with the coating rolls and thus from transfer to the strip surface.

Figure 7:
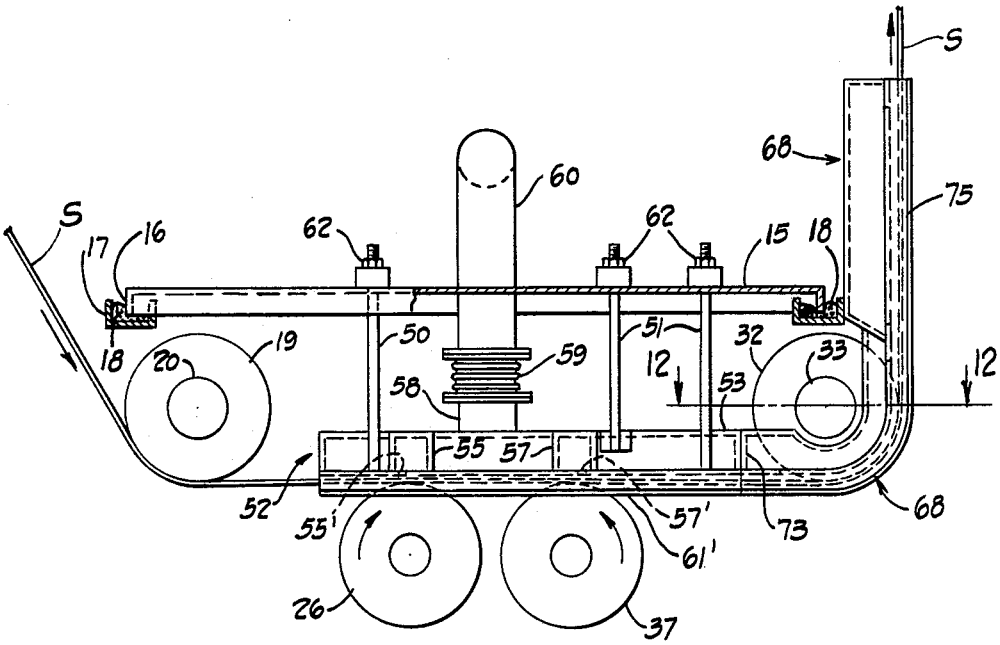
FIG. 7 is an illustrative schematic vertical cross sectional view, taken approximately on line 7—7 of FIG. 6, illustrating the path of travel of the strip through the galvanizing pot and the positions of the coating rolls, gas manifolds, etc.

As best seen in FIGS. 1 and 7, the strip S moves downwardly within the housing H, through the slot 49' in baffle plate 49 (see FIG. 2), into the galvanizing pot J. The strip then passes under the entering turning roll 19, over the first coating roll 26 and second coating roll 37, under the exit turning roll 32 and then through the upwardly extending coating weight control section, generally indicated at 45, of the galvanizing pot structure J. A baffle plate 46 having a slot 46' extending therethrough extends across the upper portion of the weight control section 45, (see FIG. 2). The slot 46' is wide enough to permit free passage of the widest strip to be processed and this baffle plate, together with baffle plate 49, serves to assist in maintaining the desired atmosphere and temperature in the pot structure J. After passing through the slot 46', the strip leaves the pot structure J and continues in the housing H through the cooling structure K of the line as seen in FIG. 1.

Figure 6:
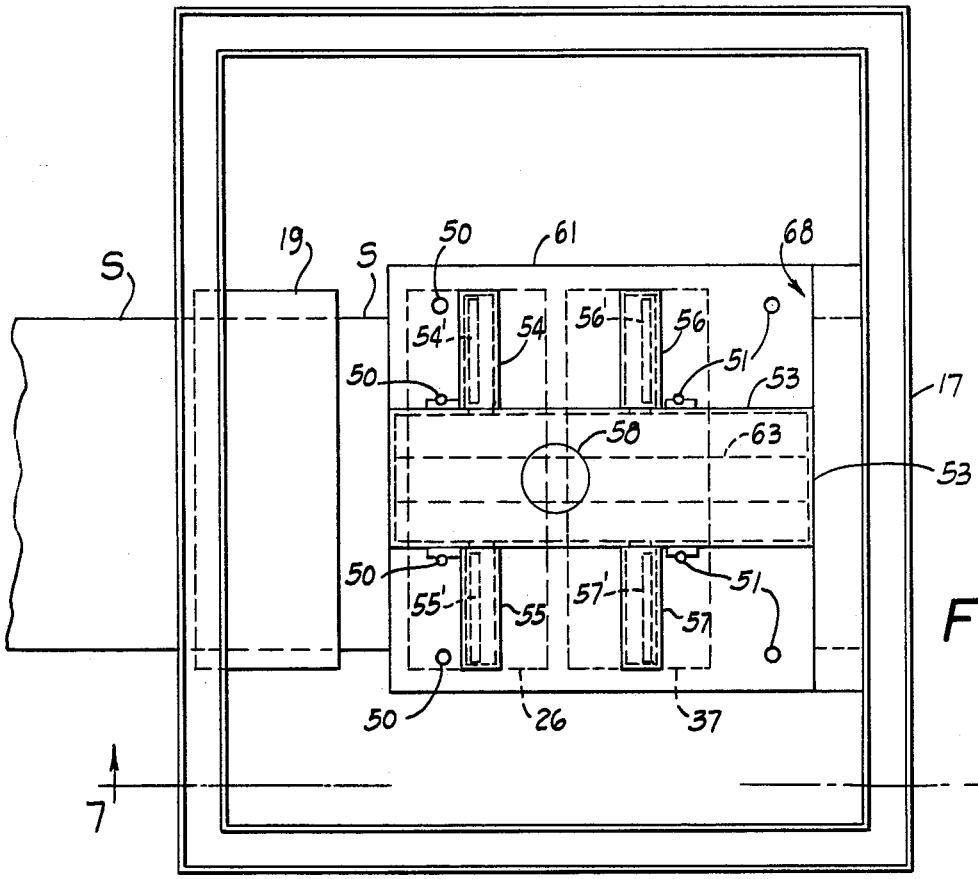
FIG. 6 is an illustrative view of a portion of the top of the galvanizing pot with the cover removed better to show the manifolds, etc. supported thereby.

Supported on rods 50 and 51 which extend downwardly from the removable cover 15 is the horizontal gas manifold and deflector plate unit, generally indicated at 52 and best seen in FIGS. 2, 4 and 7. This unit has a central section 53 which extends in the direction of travel of the strip S, and transversely extending sections 54, 55, 56 and 57. The gas inlet pipe 58 extends upwardly from the center section 53 and is connected by a flexible coupling 59 to the gas supply pipe 60 which is supported by and extends through the removable cover 15. The bottom of the manifold 52 comprises the gas deflector plate 61 which, as seen in FIGS. 4 and 6, is wider than the coating rolls 26 and 37, wider than the maximum strip width to be processed, and extends in the direction of strip travel for the full length of the center section 53. The opposite longitudinal edges of deflector plate 61, indicated at 61', are curved downwardly for purposes which will appear later in the description of the operation of the apparatus.

The vertical position of the bottom of the deflector plate 61 is adjusted by the nuts 62 on the threaded upper ends of the manifold support rods 50 and 51 which extend through the removable cover 15 so that it lies in spaced, substantially parallel relation to the uncoated side of strip S. A longitudinal gas discharge slot 63 extends the full length of the deflector plate 61 and transverse slots 54', 55', 56' and 57' extending axially of rolls 26 and 37 respectively, are formed in the plate 61 where it forms the bottom wall of the transverse sections 54, 55, 56 and 57 of the manifold 52. As is best seen in FIG. 6, and for purposes which will be later explained, the slots 54', 55', 56' and 57' lie ahead of a vertical plane through the axial center lines of the coating rolls 26 and 37 respectively. The term "ahead" as used herein means toward the oncoming surface of the particular coating roll and of course, therefore, depends upon the direction of rotation of the roll. The length of the slots 54', 55', 56' and 57' is such that they lie over the upper exposed surface areas of the rolls 26 and 37 and extend outwardly beyond the edges of a strip of the maximum width which can be processed in the particular apparatus involved and inwardly beyond the edges of a strip of the minimum width that can be processed. To prevent adherence of molten zinc to the plate 61 it is preferably made of an alloy of tungsten or aluminum or other material to which the coating material will not adhere.

From the above description of the manifold and deflector plate unit 52, it will be understood that when gas under pressure is delivered to the manifold through the inlet pipe 58, it will be discharged outwardly through the longitudinally extending slot 63 and the transversely extending slots 54', 55', 56' and 57' in the deflector plate 61 which forms the bottom of the manifold structure. As seen in FIGS. 4 and 5, the vertical position of the bottom surface of the deflector plate 61 relative to the top uncoated surface of the strip S is adjustable by the manifold support rods 50 and 51 so that the gap 64 (FIG. 5) provides the desired clearance space between the top surface of the strip S and bottom surface of the deflector plate 61. Accordingly, gas discharged under pressure through the longitudinal slot 63 in the deflector plate 61 will move outwardly and transversely of the strip length in both directions from the longitudinal center line of the strip, to and over the edges thereof. This outward gas blast which is maintained at high velocity and continuously during the coating operation, effectively prevents the travel of molten zinc to the upper uncoated surface of the strip S.

The transverse slots 54', 55' and 56', 57' in plate 61 overlie a portion of the top surface and extend beyond the edges of the strip being processed and direct elongated jets or blasts of gas against the exposed top surfaces of the coating rolls 26 and 37 which are not covered by the strip being processed. These blasts prevent molten zinc on the exposed surfaces of the coating rolls which project beyond the strip edges from being thrown off by virtue of the rotation of the rolls with resulting possible splatter of zinc particles to the top surface of the strip. This gas wiping of molten zinc from the exposed upper portion of the rolls 26 and 37 between the edges of the strip and the ends of the rolls, by preventing an undesirable quantity of molten zinc from being present on the coating roll surfaces from the strip edges to the ends of the rolls at the tops of the rolls, also eliminates the possibility of a thickened "edge bead" of zinc on the edges of the strip.

In order to continue the discharge of gas outwardly over the edges of the strip as it moves through the galvanizing pot, the corner and vertical manifold and deflector plate structure 68 is supported on the upwardly extending wall 45' (see FIG. 2) of the vertically extending weight control section 45 of the galvanizing pot J (see FIG. 2). As will appear from the following description this manifold and deflector plate structure 68 continues the outward blast of gas over the opposite edges of the uncoated side of strip S as it travels around the exit turning roll 32 and moves upwardly in a generally vertical path, above the surface of the zinc bath 13 through the weight control section 45. The upper end 69 of manifold unit 68 is located at a point in the travel of the strip S where the zinc coating thereon has solidified sufficiently so that it will not travel around the strip edges to the uncoated surface thereof.

Figure 9:
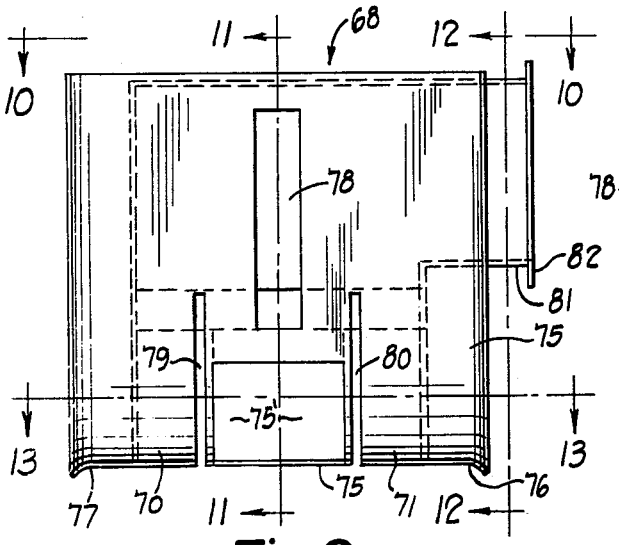
FIG. 9 is a side elevational view of the manifold unit illustrated in FIG. 8, taken substantially on line 9—9 of FIG. 8.
Figure 11:
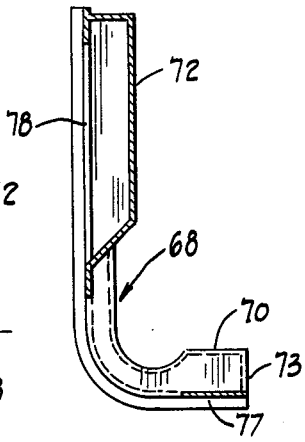
FIG. 11 is a vertical cross sectional view taken substantially on line 11—11 of FIG. 9.
Figure 12:
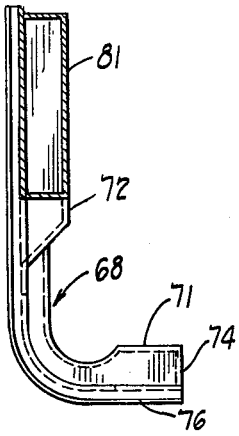
FIG. 12 is a vertical cross sectional view taken substantially on line 12—12 of FIG. 9.
Figure 10:
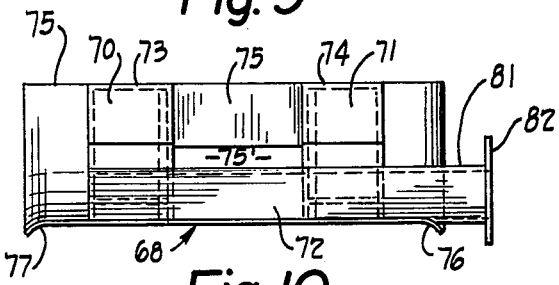
FIG. 10 is a top elevation of the manifold unit shown in FIG. 9 taken substantially on line 10—10 of FIG. 9.
Figure 13:
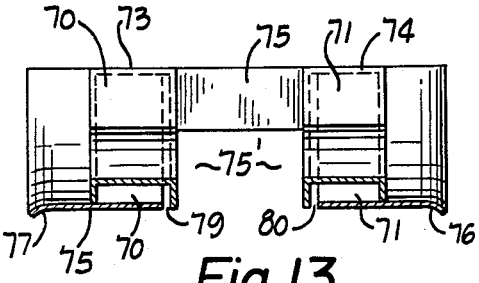
FIG. 13 is a horizontal cross sectional view taken substantially on line 13—13 of FIG. 9.

As best seen in FIGS. 7–13, the manifold and deflector plate unit 68 includes an upper gas manifold portion 72 and a lower portion comprising a pair of spaced lower sections 70 and 71. These lower sections lie adjacent the opposite ends of the exit turning roll 32 and extend vertically downwardly from the upper manifold portion 72. The lower sections 70 and 71 each comprise walls forming manifolds which open into the upper manifold 72. They extend downwardly to approximately the center line of exit turning roll 32 and then turn through 90° and extend horizontally to their ends 73 and 74. These ends lie adjacent and in line with the end of the center section 53 of manifold 52 (see FIG. 7) and the sections 70 and 71 extend around the shaft 33 of the exit turning roll 32. The lower and outer wall of the corner and vertical manifold structure 68 is formed by a gas deflector plate 75 which has its edge portions 76 and 77 curved in the same manner as the edges of horizontal deflector plate 61 and for the same purpose. The end of the deflector plate 75 on the horizontal portion thereof abuts and is aligned with the end of the deflector plate 61 of the manifold unit 52. A gas discharge slot 78 is formed in the vertical portion of the deflector plate 75 and gas discharge slots 79 and 80 are formed in the deflector plate 75 in the curved lower sections thereof. As best seen in FIG. 9, these slots 79 and 80 extend in an upward direction somewhat beyond the lower end of the centrally located slot 78. A portion of the central area of deflector plate 75 which extends around the 90° bend thereof is cut away to provide an opening 75' (see FIG. 8) to permit the portion of turning roll 32 which engages the strip S to project through the plate 75 and hold the strip in spaced relation to the plate during its travel thereover.

To provide means for conveying gas under pressure into the manifold unit 68, a duct 81 projects from the upper manifold 72 and has a flange 82 by which it is connected to the correspondingly shaped extension 83 of gas inlet pipe 84 which in turn connects to the discharge pipe 85 of the blower 86 (see FIG. 3). Gas which enters the manifold unit 68 is discharged therefrom through the slots 78, 79 and 80. As best seen in FIG. 5, the strip S is spaced from the adjacent surface of the deflector plate 75 by clearance indicated at 64 so that the atmosphere discharged through slots 79 and 80 moves at high velocity transversely outwardly over the uncoated surface of the strip and across the outer edges thereof from a point immediately adjacent the end of the slot 63 in manifold 52. This flow of gas across the strip edges is maintained as the strip changes its direction from horizontal to vertical when it passes around the exit turning roll 32. As gas is also being simultaneously discharged through the slot 78 in the vertical portion of manifold 68, and as the upper end of the slots 79 and 80 overlap the lower end of slot 78 (see FIGS. 8 and 9), a continuous transverse flow of gas across the uncoated side and edges of the strip S is maintained throughout its travel from the end of the center section 53 of horizontal manifold 52 to the upper end 69 of the corner and vertical manifold 68. The exit strip turning roll 32 substantially fills the opening 75' in the deflector plate 75 and thus restricts undesirable flow of gas past the roll 32.

As illustrated, the gas which is utilized to prevent contact of the molten zinc with the uncoated side of the strip S is withdrawn from the enclosed housing of the galvanizing pot J through a pipe 87 which enters the vertical upward extension of the zinc pot housing as seen at 88 (see FIG. 2). The blower 86 is of the centrifugal type, its inlet pipe 87 extending to the center of one side thereof and its outlet pipe 85 extending tangentially from the blower casing. As best seen in FIGS. 2 and 3 the blower outlet pipe 85 extends through a flexible coupling 85' and is attached by a coupling 89 to the pipe 60, which, as previously noted, is carried by and extends downwardly through the cover portion 15 of the galvanizing pot housing. Another flexible coupling 84' is inserted in the pipe 84 which leads from blower discharge pipe 85 to the gas inlet duct 81 of the corner and vertical manifold structure 68. If desired heat may be added to the pot atmosphere while it is being circulated by the blower 86. An adjustable control valve 85" in pipe 85 adjacent the coupling 89 and an adjustable control valve 84" in pipe 84 adjacent the coupling 84' provide means for independently varying the flow of gas to the manifold and deflector unit 52 and to the manifold and deflector unit 68. These valves permit the operator to maintain the gas velocity across the strip edges that is required to prevent contact of molten zinc with the uncoated side of the strip S.

As has been previously explained, the gas in the zinc pot housing is protective to steel and molten zinc and its temperature in the coating area is such that the temperature of the strip is maintained in the desired range for galvanizing. The length of upper manifold portion 74 is preferably such that the upper end 69 thereof has become low enough to substantially solidify the zinc coating. However, if necessary in order to cool the zinc coating on the strip S to a point where it will not flow on the strip surface when the strip reaches the upper end 69 of the corner and vertical manifold unit 68, suitable cooling means, such as pipes 90 (FIG. 2) with cooling liquid flowing therethrough, may be positioned adjacent the path of the strip S opposite the upper portion of the upper gas manifold section 72 of corner manifold unit 68. These pipes 90 are preferably enclosed on the side away from strip S by an insulated shield 90' so that only the strip is cooled thereby.

After the direction of travel of the strip S has been changed from horizontal to vertical by the exit turning roll 32, and while the zinc coating thereon is still in fluid condition and the path of the strip is directly above the surface of the zinc bath 13, the thickness or weight of the coating may be controlled by a "gas wipe" mechanism generally indicated at W, see FIGS. 2, 3, 14, 15 and 16. The use of an elongated jet of gas directed against the surface of a strip of steel which has been coated with molten zinc to control the coating thickness or weight while the zinc is still in fluid condition is well known in the strip galvanizing art. Customarily air or steam is used as the gas in these gas wipe mechanisms. In the present one side galvanizing procedure, the weight of the zinc coating is controlled by a gas wipe mechanism which utilizes the same protective gas as is employed to prevent access of molten zinc to the uncoated side of the strip as has been previously described.

Figure 14:
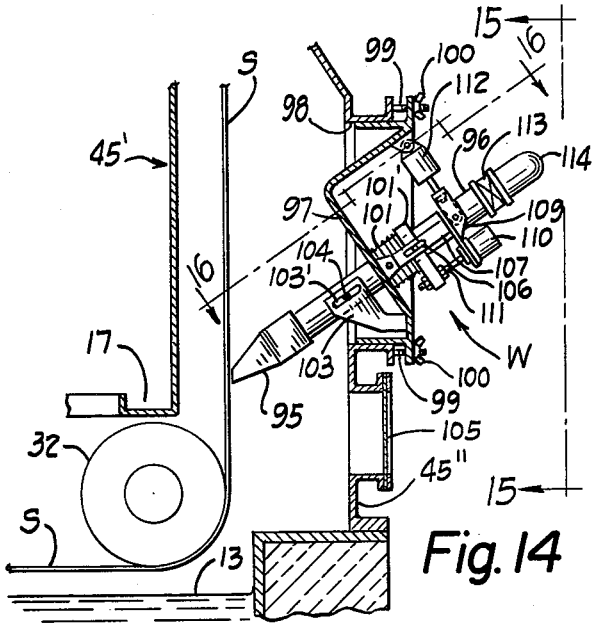
FIG. 14 is a detached side elevational view, partly in cross section, illustrating the gas wipe nozzle for controlling the thickness or weight of the zinc coating on the strip, together with its supporting and adjusting means.
Figure 16:
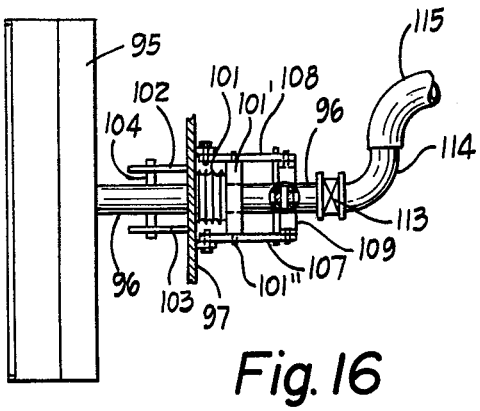
FIG. 16 is a view taken substantially on line 16—16 of FIG. 14.

The gas wipe mechanism W (FIGS. 2, 14, 15 and 16) comprises an elongated nozzle 95 positioned to direct an elongated wiping jet of the atmosphere from within the protective housing H against the coated side of the strip while the zinc is still fluid and the strip is traveling in an upward direction above the zinc bath 13 after passing around the turning roll 32. The nozzle 95 is supported on, and supplied with gas under pressure through, a pipe 96. This pipe 96 extends through a removable panel 97 which is secured in an opening 98 in the outer wall portion 45" of the weight control and preliminary cooling section 45 of the zinc pot J. Screws 99, provided with thumb nuts 100, removably secure the panel 97 in place. The pipe 96 extends through a hole in panel 97 somewhat larger than the diameter of the pipe and a flexible seal 101 maintains a gas tight connection between the pipe 96 and the panel 97 while permitting axial and angular movement of the pipe 96 therethrough. Referring particularly to FIGS. 14 and 16, brackets 102, 103 extend inwardly from the panel 97 and are slotted as seen at 103' to receive a transverse pin 104 secured to pipe 96.

From the above description, it will be observed that the flexible seal member 101, the pin 104 on the pipe 96 and the slotted brackets 102, 103 provide a support for the pipe 96 and the elongated nozzle 95 whereby the position of the nozzle relative to the adjacent surface of the strip S may be adjusted in or out toward or away from the strip and up or down to vary the angle at which the wiping jet strikes the still fluid zinc on the coated side of the strip. These adjustments may be effected from outside of the zinc pot housing and, if desired, without stopping the travel of the strip S through the coating line. By varying the position of the outlet of nozzle 95 relative to the coated surface of the strip S the weight of the zinc coating may be controlled. A glass observation port 105 is mounted in the outer wall 45" of the weight control section 45 so that the position and action of the gas wipe jet may be observed.

Figure 15:
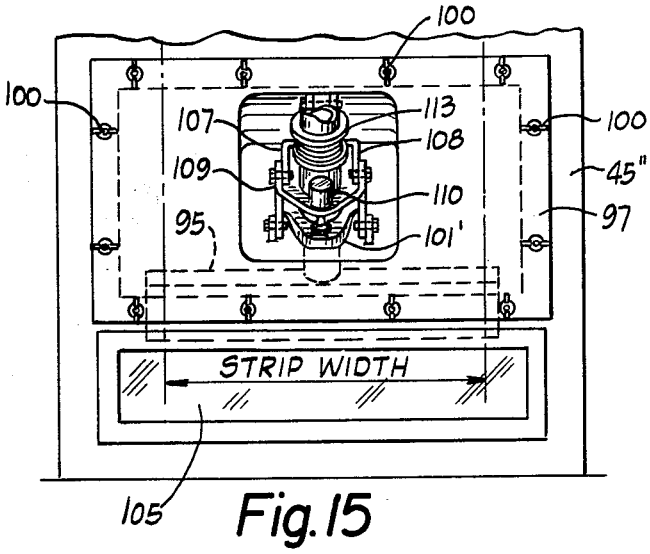
FIG. 15 is a view taken substantially on line 15—15 of FIG. 14.

To effect accurate in and out adjustment of the nozzle 95 the collar 101' of the flexible seal 101 is secured to pipe 96. As best seen in FIGS. 14, 15 and 16, this collar 101' carries outwardly projecting pins 101" which extend through slots 106 in arms 107 and 108 which are pivotally mounted on and extend outwardly from the panel 97. The outer ends of arms 107 and 108 are connected by a transversely extending member 109 which is also secured to the pipe 96 and has a lower portion extending below pipe 96 on which is mounted a hydraulic cylinder 110. The piston rod 111 of cylinder 110 extends to and is connected with the lower end of the collar 101'. A second hydraulic cylinder 112 is pivotally mounted on the panel 97 as seen in FIG. 14 and the lower end of its downwardly projecting piston rod is pivotally connected to the transverse member 109. As seen in FIG. 16, the outer end of pipe 96 is connected by a flexible coupling 113 to an elbow 114 which in turn connects to a flexible pipe or hose section 115 which leads to the outlet of the gas wipe blower 116. The inlet pipe 117 to blower 116 connects to the inlet pipe 87 of the main blower 86.

From the above description of the gas wipe mechanism it will be observed that when the blower 116 is operating, gas will be withdrawn by blower 116 from the interior of the galvanizing pot housing through the pipes 87 and 117 and will be discharged through the pipes 115, 114 and 96 to the elongated nozzle 95 by which it is directed across the entire width of the coated surface of the strip S as it moves upwardly past the upper gas manifold 72 of the manifold unit 68. By suitable hydraulic connection and valves, not shown, the hydraulic cylinder 110 may be operated to move the pipe 96 axially so that the nozzle 95 is adjusted toward or away from the strip surface. By suitable piping and valves, not shown, the hydraulic cylinder 112 may be operated to lift or lower the outer end portion of pipe 96 about the pivot formed by the pin 104 in the elongated slots 103' in the brackets 102 and 103. This movement of the outer end of pipe 96 will effect opposite up or down adjustment of the position of nozzle 95. The flexible seal 101 and linkage connections described above permit this adjustment to be accurately and easily made from outside of the zinc pot structure under observation through the port 105 and without necessarily stopping the coating operation.

After the strip S leaves the weight control section 45 of the galvanizing pot J through the slot 46' in the baffle plate 46 it continues to travel upwardly within the housing H through a secondary cooling section K which is diagrammatically illustrated in FIG. 1 and which may comprise any suitable means, gaseous or liquid, for cooling the strip to a temperature such that when it leaves the cooling section K, it will not become oxidized by exposure to air. This temperature is generally about 200° to 300° F.

The overall operation of my improved one side coating method and apparatus, as specifically applied to one side galvanizing of steel strip, will now be described.

Referring to FIG. 1, strip steel from either of the coils A is fed in well known manner through the leveller B, the shears C, the welder D and the looper E to the tension bridle rolls F. As previously noted, the tension bridle rolls L', which comprise the first set of rolls of the tension leveller L and which are located just beyond the exit of the strip S from the housing H at the end of the cooling section K, draw the strip through the entire line from the tension bridle rolls F. These rolls F provide the resistance which enables the rolls L' to maintain the desired tension in the strip while moving it at the desired lineal speed.

As the strip passes through the furnace section G, which may be of any suitable and well known type, it is progressively heated and may, if desired, be annealed or otherwise heat treated as it travels through the furnace section. The atmosphere within the furnace is such that the surface of the strip is prepared and maintained in condition for galvanizing and protected against oxidation. Protective gaseous atmospheres are maintained through the housing H which encloses the furnace G, the galvanizing pot apparatus J and the cooling section K. By providing the slotted baffles 46 and 49 in the path of travel of the strip through the housing H and suitable gas supply means G', J' and K', the composition and pressure of the atmosphere in particular locations along its travel through the line may be controlled as desired.

When the strip passes through the baffle 49 and reaches the galvanizing pot J it travels over the entering turning roll 19 and then in a horizontal direction over the first coating or wetting roll 26. The periphery of this wetting roll travels in the same direction as the strip and preferably at substantially the same velocity. The roll is vertically adjusted by means of the described mechanism to be in contact with the bottom surface of the strip and it is greater in length than the widest strip to be processed in the line.

As the roll 26 rotates in the zinc bath 12 it picks up molten zinc on its surface and applies a coating of zinc across the entire width of the bottom side of the strip S as it passes thereover, regardless of the width of the strip being processed. In some cases this may be sufficient for the one side coating operation and the second coating roll 37 would not be employed. However, in the embodiment illustrated the second coating roll 37 is supported closely adjacent to the first coating roll 26 and its vertical position is adjusted so that its top periphery is preferably very slightly spaced from the bottom surface of the strip by a distance sufficient to permit the deposit on the strip of an additional layer of molten zinc of the desired thickness. This roll 37 is also wider than the maximum strip width to be handled so that regardless of the strip width passing through the apparatus its entire surface will be uniformly coated.

As illustrated, the roll 37 is driven to rotate in a direction such that its upper periphery travels in a direction opposite to the direction of strip travel. By this arrangement, zinc is picked up by the roll as it rotates in the bath 12 and carried up to the line of tangency of the roll and the strip on the side of the line of tangency toward the direction of travel of the strip. This counter rotation of the roll 37 facilitates the deposit of the additional coating thickness which is desired.

The deposit of zinc which may splatter from the rolls 26 and 37, or which might travel or creep from the bottom surface of the strip around the edges thereof to the top surface, is effectively prevented by the high velocity flow of gas, which is preferably the same protective gas as is maintained within the pot structure J, from the longitudinally extending slot 63 in manifold 52 across the strip transversely of its direction of travel and outwardly from the center of the strip through the narrow space which is maintained between the bottom surface of the deflector plate 61 and the top surface of the strip S. The downwardly curved edge portions 61' of plate 61 extend toward the strip S and assist in maintaining the gas flow over the strip edges and deflect molten zinc picked up by the gas stream away from the strip and downwardly to the zinc bath 12.

As best seen in FIG. 2, this flow of gas over the edges of the strip is initiated in an area somewhat ahead of the line where the strip first receives a coating of zinc from the roll 26 and continues through the length of the manifold 52 and its deflector plate 61. In similar manner, this outward flow of gas over the strip edges is maintained as the strip is moved around the exit turning roll 32 and passes upwardly over the upper portion 72 of the corner and vertical manifold and deflector plate structure 68. As previously noted, by the time the strip reaches the upper end 69 of manifold 68 the zinc coating thereon has reached a non-flowing condition so that it will no longer travel around the strip edge to the opposite side. Thus, the gas manifold and deflector plate units 52 and 68 extend from an area of the uncoated upper side of strip S which is opposite the area of first contact of coating material with the bottom coated side of the strip to the area in the movement of the strip where the coating thereon becomes substantially nonfluid.

When strip of minimum width is being coated, as indicated in FIGS. 4 and 5, substantial portions of the outer ends of the rolls 26 and 37 will not be covered by the strip. In view of the possibility of zinc picked up by the rolls being thrown off in the form of droplets which might be deposited on the uncoated side of the strip, the transverse manifold portions 54, 55, 56 and 57 are provided. Gas from the manifolds 54 and 55 is directed downwardly through the slots 54' and 55' against the upper exposed portions of the roll 26 in a line in an area ahead of the line of contact of the roll with the strip S. As will be observed from FIG. 4 this downward blast of gas will force the molten zinc downwardly from the upwardly moving surface of the roll 26 and prevent splatter therefrom which might be deposited on the top surface of the strip. Furthermore, this gas blast will also prevent the deposit of excess quantities of molten zinc immediately adjacent the edges of the strip which might result in a thickened bead forming at these locations.

In similar manner, the manifolds 56 and 57 carry gas under pressure which is discharged through their slotted outlets 56' and 57' downwardly against any portions of the second coating roll 37 which may be exposed depending on the width of strip being processed. As seen in FIG. 2, the slots 56' and 57' are located offset from the point of tangency of the strip and the roll 37 in the direction from which the surface of the roll moves toward the strip. In other words, the blast of gas from the slots 56' and 57' removes the molten zinc from the surface of the roll 37 ahead of where the strip and roll become tangent. As the roll 37 rotates in the opposite direction from roll 26 the slots 56' and 57' are located on the opposite sides of the vertical center line of roll 37 as compared to the relation of slots 54' and 55' to the vertical center line of roll 26.

After the strip passes through the baffle plate 46 as it leaves the zinc pot and coating control section J (FIG. 1) it travels through the cooling section K in which a protective atmosphere is maintained. In the cooling section K the atmosphere may be circulated and externally cooled or other means provided to expedite reduction of the temperature of the strip to a point where, when it leaves the housing H, it will not be oxidized by contact with the air. As previously explained, the first bridle rolls L' of the stretcher leveller unit L draw the strip at the desired tension and velocity through the entire line from the entering tension bridle F. The second set of bridle rolls L" of the leveller L exert the desired tension on the strip to produce the required levelling as the strip moves between the roll sets L' and L".

The exit tension bridle N draws the strip from the leveller L through the looper M which is provided to enable strip to accumulate without stopping its travel through the line when the end of the strip is stopped to be severed by the shears R and to have its end secured to the mandrel of one of the coilers Q for starting a new coil. Between the looper M and the tension rolls N the strip passes through the chemical treatment section P in which the clean or ungalvanized side may be given a protective coating or the strip otherwise processed.

It will be understood that although the illustrated one side steel strip galvanizing apparatus and procedure has been described in detail, this description and the accompanying drawings are illustrative rather than restrictive. Other metals than zinc, for example lead, cadmium, tin or various alloys, as well as other strip materials which may be metallic, fibrous, plastic or the like, may be employed when it is desired to continuously produce a one side coated strip material without contact of the coating material with the opposite uncoated side.

I claim:

1. Apparatus for coating one side only of a strip material including a vessel having a bath of coating material in fluid condition therein, said coating material being adapted to change to substantially non-fluid condition after leaving said bath, a coating roll supported for rotation in said vessel partially submerged in said bath whereby said fluid coating material is picked up on the surface of said roll while rotating, means for moving said strip longitudinally in a path over said roll whereby one side only of said strip engages the fluid coating material on said roll and said coating material is transferred to said one side of said strip, gas manifold means extending in the direction of strip movement above said coating roll and said path of said strip thereover for a distance greater than the diameter of said coating roll, said manifold means having gas outlet means adapted to direct gas from said manifold means outwardly over both edges of the opposite uncoated side of said strip in unbroken flow from the area of first engagement of said strip and said coating material for a distance in the direction of strip movement greater than the diameter of said coating roll whereby contact of said coating material in fluid condition with said opposite side of said strip is prevented, and means for maintaining a flow of gas through said outlet means in said manifold.

2. One side coating apparatus according to claim 1 including a housing for said vessel and means for maintaining a gaseous atmosphere therein.

3. One side coating apparatus according to claim 2 in which the gaseous atmosphere which flows over the strip edges is supplied from the gaseous atmosphere in said housing.

4. One side coating apparatus according to claim 1 in which means are provided for directing a flow of gaseous atmosphere against the upper exposed surface areas of said roll which are not covered by said strip whereby splatter of coating material from the roll as it rotates is prevented.

5. One side coating apparatus according to claim 4 in which said means for directing gaseous atmosphere against the upper exposed surface areas of said roll extend axially of said roll from the narrowest strip width to be processed outwardly to each end of the roll whereby splatter from the exposed surface of the roll is prevented regardless of the width of the strip being processed.

6. One side coating apparatus according to claim 1 in which said gas manifold means includes a deflector plate supported in spaced substantially parallel relation to said opposite uncoated side of said strip and extending transversely outwardly to the edges thereof, and said gas outlet means extends through said deflector plate and is adapted to direct said gas through the space between said plate and said opposite side of said strip from the central area of said strip outwardly in both directions and over both edges thereof.

7. One side coating apparatus according to claim 6 including a housing for said vessel and means for maintaining a gaseous atmosphere therein.

8. One side coating apparatus according to claim 7 in which the gaseous atmosphere which flows over said opposite side of said strip is supplied from the gaseous atmosphere in said housing.

9. Apparatus for coating one side only of a strip material including a vessel having a bath of coating material in fluid condition therein, a housing for said vessel, means for maintaining a gaseous atmosphere in said housing, a coating roll supported for rotation in said vessel partially submerged in said bath whereby said fluid coating material is picked up on the surface of said roll while rotating, means for moving said strip longitudinally over said roll whereby one side only of said strip engages the fluid coating material on said roll and said coating material is transferred to said one side of said strip, means for maintaining a flow of gaseous atmosphere transversely of the direction of travel of said strip and outwardly over both edges of the opposite uncoated side thereof whereby contact of coating fluid with said opposite uncoated side of said strip is prevented including a deflector plate supported in spaced substantially parallel relation to said opposite uncoated side of said strip and extending transversely outwardly to the edges thereof, a gas manifold within said housing adjacent said deflector plate, said plate having an aperture or apertures therein extending lengthwise thereof in the direction of strip movement, and means for discharging said gaseous atmosphere into said manifold whereby said atmosphere is forced through said aperture or apertures and outwardly between said plate and the uncoated side of the strip and across the edges thereof with sufficient velocity to prevent the contact of fluid coating material with said uncoated side of said strip, said gaseous atmosphere which flows over said opposite side of said strip being supplied from the gaseous atmosphere in said housing.

10. One side coating apparatus according to claim 9 in which said deflector plate extends from an area on said uncoated side of the strip which is opposite the area of first contact of coating material with said one side of said strip to the area in the movement of the strip where the coating thereon becomes substantially non-fluid.

11. One side coating apparatus according to claim 9 in which said means for maintaining a flow of gaseous atmosphere includes blower means, a gas intake connection from the interior of said housing to said blower means, a gas outlet connection from said blower means to said manifold, and means for controlling the flow of gaseous atmosphere through said connection from said blower to said manifold.

12. One side coating apparatus according to claim 9 in which said deflector plate has an atmosphere outlet slot or slots, extending axially of said roll and transversely of the strip outwardly beyond the edges of a strip of the maximum width which can be processed in the particular apparatus involved and inwardly beyond the edges of a strip of the minimum width that can be processed, said slot or slots being adapted to direct atmosphere from said manifold downwardly against the upper portions of said roll which are exposed by said strip and to prevent splatter of coating material therefrom.

13. In apparatus for one side steel strip galvanizing having a strip heating furnace section, a galvanizing pot structure including a vessel having a bath of molten zinc therein, a strip cooling section, and means for moving the strip continuously through said furnace, pot structure and cooling section, the provision of a gas retaining housing around said furnace, pot structure and cooling section, means for maintaining a protective gas atmosphere within said housing, a coating roll supported for rotation in said vessel partially submerged in said zinc bath, means for rotating said coating roll in said zinc bath whereby molten zinc is picked up on the surface thereof, means for guiding said strip through said galvanizing pot structure with its lower side above said zinc bath level and in contact with the molten zinc on said coating roll whereby a coating of molten zinc is transferred to said lower side of the strip, and means for maintaining a flow of said protective gas from within said housing over the opposite uncoated side of said strip outwardly over both edges thereof whereby contact of molten zinc with said opposite side of said strip is prevented, said flow maintaining means including a deflector plate supported in spaced substantially parallel relation to said uncoated side of said strip and extending transversely outwardly to the edges thereof and having a slot therethrough extending lengthwise in the direction of strip movement, a gas manifold within said housing, a gas-conducting connection between said manifold and said deflector plate, and blower means for forcing gas through said slot into the space between said strip and said deflector plate and outwardly over both strip edges with sufficient velocity to prevent contact of molten zinc with said uncoated side of the strip.

14. Apparatus for one side galvanizing of steel strip according to claim 13 in which said deflector plate has a transverse gas outlet slot or slots extending axially of and above said roll outwardly beyond the edges of a strip of the maximum width which can be processed in the particular apparatus involved and inwardly beyond the edges of a strip of the minimum width that can be processed whereby gas from said manifold is directed downwardly against the exposed upper portions of said roll to prevent splatter of zinc from said roll.

15. Apparatus for one side galvanizing of steel strip according to claim 14 in which said transverse gas outlet slot or slots are positioned ahead of a vertical plane through the axial center line of said roll.

16. Apparatus for one side galvanizing of steel strip according to claim 13 in which said deflector plate extends from an area on said uncoated side of the strip which is opposite the area of first contact of molten zinc with said lower side of said strip to the area in the movement of the strip where the zinc thereon becomes substantially non-fluid.

17. Apparatus for one side galvanizing of steel strip according to claim 16 including nozzle means for directing a wiping jet of said gas from within said housing against said coating of molten zinc on said strip across the entire width thereof while said zinc is in fluid condition whereby the weight of said coating on said strip is controlled.

18. Apparatus for one side galvanizing of steel strip according to claim 17 which includes means, operable from outside of said housing, for adjusting the position of said nozzle means toward or away from the strip and for varying the angle at which said wiping jet strikes said strip.

19. Apparatus for one side galvanizing of steel strip comprising a holding vessel adapted to hold a bath of molten zinc therein, an entering strip turning roll and an exit strip turning roll positioned to guide a strip in a path above and substantially parallel to the surface of said zinc bath, a strip coating roll positioned to transfer molten zinc from said bath to the lower surface of said strip, a gas manifold and deflector plate unit, said plate having a gas outlet therethrough extending in the direction of strip travel a distance greater than the diameter of said coating roll, means for supporting said unit in said vessel with said plate above and substantially parallel to the upper surface of said strip as it travels between said entering and exit rolls, and means for supplying gas under pressure to said manifold and gas outlet in said plate whereby gas from said manifold passes transversely of said plate outwardly over the edges of said strip.

20. Apparatus for one side galvanizing of steel strip according to claim 19 in which said means for supporting said manifold and deflector plate unit is adjustable whereby the gap between said plate and said upper surface of said strip may be regulated.

21. Apparatus for one side galvanizing of steel strip comprising a molten zinc holding vessel, a bath of molten zinc in said vessel, an entering strip turning roll and an exit strip turning roll positioned to guide a strip therebetween in a generally horizontal path above the surface of said zinc bath, means for turning said strip around said exit strip turning roll so that its path is upward, gas manifold and deflector plate means extending adjacent to and above said strip in its said generally horizontal path and continuing around said exit turning roll and adjacent to said strip in its upward path, said plate having gas outlet means therethrough, and means for supplying gas under pressure to said manifold whereby gas is forced through said outlet means in said plate and transversely outwardly over both edges of said strip and contact of molten zinc with the adjacent side of said strip is thereby prevented.

22. Apparatus for one side galvanizing of steel strip according to claim 21 in which said upward path of said strip is disposed over the surface of said zinc bath, and nozzle means are provided for directing a wiping jet of gas against said coating of molten zinc on said strip across the entire width thereof in said upward path of said strip and opposite the upwardly continuing portion of said manifold and deflector plate means whereby the weight of the coating of zinc on said strip is controlled and surplus zinc removed by said wiping jet returns to said zinc bath.

23. Apparatus for one side galvanizing of steel strip according to claim 21 including control valve means in said means for supplying gas under pressure to said manifold whereby the flow of gas over said strip edges may be varied.

24. Apparatus for one side galvanizing of steel strip according to claim 21 in which said deflector plate means has curved longitudinal edge portions which extend toward the strip and are positioned to deflect molten zinc toward said zinc bath.

* * * * *